US005174458A

United States Patent [19]

Segati

[11] Patent Number: 5,174,458

[45] Date of Patent: Dec. 29, 1992

[54] COLLAPSIBLE CONTAINER

[75] Inventor: Umberto D. I. Segati, Vincennes, France

[73] Assignee: Colgate-Palmolive Company, New York, N.Y.

[21] Appl. No.: 881,959

[22] Filed: May 12, 1992

[51] Int. Cl.[5] ..... B65D 23/00

[52] U.S. Cl. ..... 215/1 C; 220/666; 220/669; 220/674; 222/95; 222/107

[58] Field of Search ..... 383/120, 104, 119, 121, 383/122; 229/117.05, 117.06; 222/107, 105, 95, 92; 215/1 C, 11.3; 220/907, 666, 669, 674, 675

[56] References Cited

U.S. PATENT DOCUMENTS

| | | | |
|---|---|---|---|
| D. 33,214 | 9/1900 | Rheinauer . | |
| D. 226,704 | 4/1973 | Cobb | D9/158 |
| D. 321,828 | 11/1991 | Düring | D9/370 |
| 393,899 | 12/1888 | Haines . | |
| 2,147,349 | 2/1939 | Piquerez | 221/47.3 |
| 2,400,716 | 5/1946 | Sattler | 222/107 |
| 2,682,355 | 6/1954 | Robbins | 222/107 |
| 2,685,316 | 8/1954 | Krasno | 150/0.5 |
| 3,288,334 | 11/1966 | Corsette | 222/107 |
| 3,354,924 | 11/1967 | Birrell et al. | 150/0.5 |
| 3,367,380 | 2/1968 | Dickey | 150/1 |
| 3,424,218 | 1/1969 | Vanderbur, Jr. et al. | 215/1 C |
| 3,469,743 | 9/1969 | Becker | 222/105 |
| 3,559,847 | 2/1971 | Goodrich | 222/107 |
| 3,580,427 | 5/1971 | Clarke | 222/215 |
| 3,595,441 | 7/1971 | Grosjean | 222/107 |
| 3,727,803 | 4/1973 | Cobb | 222/215 |
| 3,926,341 | 12/1975 | Lhoest | 222/95 |
| 4,526,296 | 7/1985 | Berger et al. | 222/107 |
| 4,775,564 | 10/1988 | Shriver et al. | 428/35 |
| 4,850,509 | 7/1989 | Hollenberg | 383/120 |
| 5,054,631 | 10/1991 | Robbins, III | 215/1 C |
| 5,060,850 | 10/1991 | Weaver | 229/117.06 |
| 5,080,260 | 1/1992 | Düring | 222/107 |
| 5,101,990 | 4/1992 | Krishna Kumar et al. | 215/1 C |

FOREIGN PATENT DOCUMENTS

| | | | |
|---|---|---|---|
| 1153324 | 9/1983 | Canada | 215/1 C |
| 798338 | 7/1958 | United Kingdom | 222/215 |
| 1349294 | 4/1974 | United Kingdom . | |

*Primary Examiner*—Stephen Marcus
*Assistant Examiner*—S. Castellano
*Attorney, Agent, or Firm*—Richard J. Ancel; Robert C. Sullivan

[57] ABSTRACT

A collapsible container having substantially planar front and rear walls and interconnecting side walls that define inwardly extending V-shaped panels. A plurality of transversely extending stiffening grooves are provided in the front and rear panels to minimize outward bulging of the front and rear panels when the bottle is filled with a liquid material. A plurality of bridging members is formed in the side panels to bridge the adjacent side panels at a longitudinal fold line to minimize outward bulging of the side wall when the container is filled with liquid. To collapse the container the front and rear panels are urged together, and the side panels move inwardly about the longitudinal hinge line so that the bottle assumes a flat condition. The flattened bottle occupies considerably less space in waste disposal facilities.

13 Claims, 3 Drawing Sheets

COLLAPSIBLE CONTAINER

BACKGROUND OF THE INVENTION

1. Field of the Invention

The present invention relates to a collapsible container, and more particularly to a collapsible, blow molded plastic container that includes a pair of opposed, V-shaped side panels in which the apex of the V extends inwardly to define a longitudinally extending hinge or fold line along each side panel.

2. Description of the Related Art

The rapidly increasing use of blow molded plastics containers has caused significant disposal problems when the bottles are disposed of after use. In addition to the nonbiodegradability of the plastics materials from which such containers are most commonly made, the containers typically retain their original shape and are not crushed by users, thereby occupying substantial space in waste disposal sites, such as municipal landfills. Part of the reason for the absence of any significant effort on the part of users to crush or compress such containers derives from the fact that it is often difficult to do so, because of the rigidity of the containers.

Over the years several proposals have been put forward relative to the provision of a collapsible container. For example, in U.S. Pat. No. 3,367,380, which issued Feb. 6, 1968, to J. W. Dickey, there is shown a collapsible plastic container suitable for liquids and viscous materials, in which side and end walls include fold lines to permit the container to be collapsed by pressing together the rear and face panels of the container. The provision of corrugations or ribs on the front and rear panels is disclosed for providing additional strength.

Another form of collapsible container is disclosed in U.S. Pat. No. 3,727,803, which issued Apr. 17, 1973, to James Campbell Cobb. That patent discloses a molded, low density polyethylene container having a base and two opposed sides that are formed with a V-shaped fold or indentation that extends vertically so that the container can be collapsed in the same manner that a bellows is closed.

Although containers having V-shaped side walls have been disclosed for permitting the containers to be collapsed after use, the disclosed structures include shortcomings that derive from the configurations of the containers. For example, when such containers are filled with a liquid, unless the side walls are sufficiently thick to withstand the outward pressure exerted on the container walls to cause them to bow outwardly, the force necessary to collapse the container becomes excessive and discourages users from even attempting to collapse the bottles after the product has been consumed. On the other hand, if the walls of the container are sufficiently thin to permit collapse of the containers without undue force, the walls of the container tend to bulge outwardly, particularly in warmer weather when the bottle materials become more flexible with increasing temperature.

It is an object of the present invention to provide a collapsible bottle in which the walls of the bottle are sufficiently thin to facilitate collapsing, and that also is so configured as to minimize outward bulging of the walls of the container when it is filled with a liquid material.

DESCRIPTION OF THE PREFERRED EMBODIMENTS

Figure 1:
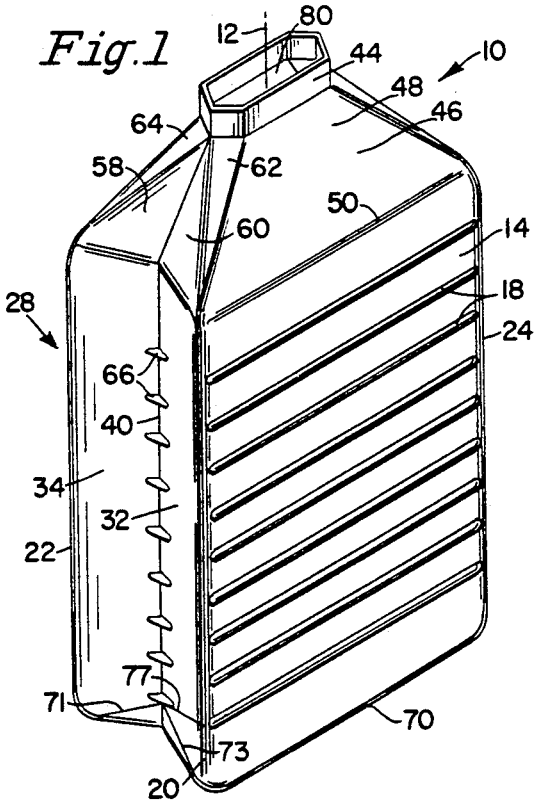
FIG. 1 is a perspective view showing a collapsible container in accordance with the present invention.
Figure 2:
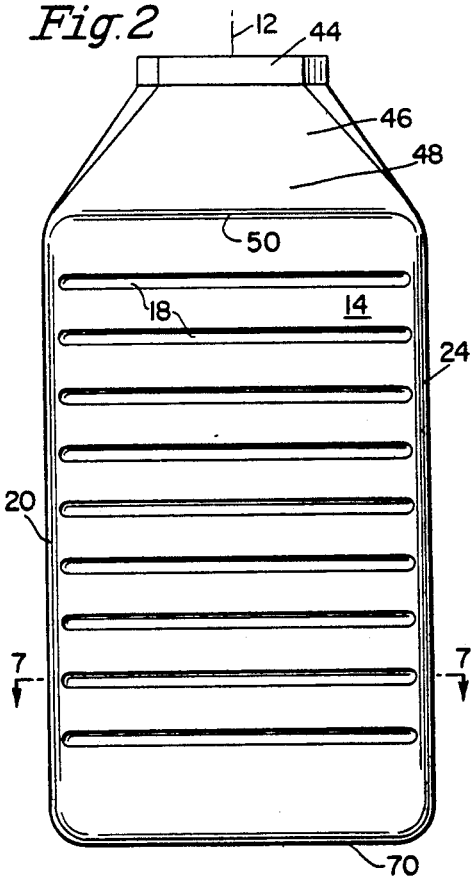
FIG. 2 is a front elevational view of the collapsible container shown in FIG. 1.
Figure 3:
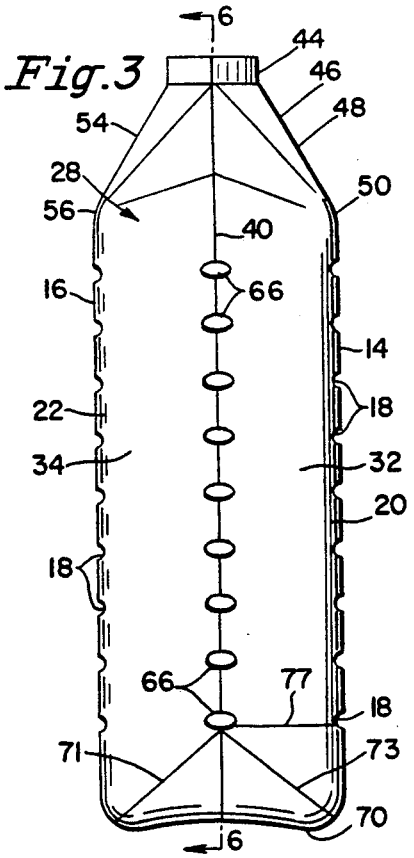
FIG. 3 is a left side elevational view of the collapsible container shown in FIG. 1.

Referring now to the drawings, and particularly to FIG. 1 thereof, there is shown a container 10 in accordance with the present invention. The container has a longitudinal axis 12 and includes a front panel 14 and a rear panel 16 (see FIG. 3), each of which is of generally rectangular form and has a predetermined, preferably uniform wall thickness. Additional rigidity, and resistance to outward bulging, can be imparted to each of front panel 14 and rear panel 16 by the integral formation therein of a plurality of transversely extending, substantially parallel grooves 18. As seen in FIG. 3, grooves 18 define elongated surface depressions in each of front panel 14 and rear panel 16.

Extending between and interconnecting the respective adjacent, longitudinally extending edges 20, 22 and 24, 26 at respective adjacent edges of front panel 14 and rear panel 16 are a left side panel 28 and a right side panel 30. Each of side panels 28 and 30 is of generally rectangular form and is defined by a pair of rectangular side walls 32, 34 and 36, 38, respectively. Side walls 32, 34, 36, and 38 are also of rectangular form and each has an outer longitudinally extending edge coincident with longitudinally extending edges 20, 22, 24, and 26, respectively, that are connected with one of front panel 14 and rear panel 16. The innermost longitudinal edges of side walls 32 and 34 are coincident and define a longitudinally extending hinge line 40 along side panel 28, and the innermost longitudinal edges of side walls 36 and 38 are coincident and define a similar longitudinally extending hinge line 42 along side panel 30. As is clearly apparent from FIG. 1, each of longitudinal hinge lines 40 and 42 is positioned inwardly of the longitudinally extending edges of the front and rear panels at substantially the transverse centerline of bottle 10, and thus side panels 28 and 30 are each a substantially V-shaped structure in which the apex of the V extends inwardly toward the longitudinal centerline of bottle 10.

An upstanding neck 44 is positioned at the uppermost portion of bottle 10 and is connected with the respective front, rear and side panels, 14, 16, 28, and 30, respectively, by a shoulder gable portion 46 that provides a smooth transition between neck 44 and the body of bottle 10. As shown in FIGS. 1 through 4, shoulder gable portion 46 is defined by a plurality of planar gable panels, including a trapezoidal front gable panel 48 extending from the upper transverse edge 50 of front panel 14 to neck 44, and a correspondingly shaped rear gable panel 54 (see FIGS. 3 and 4) extending from the uppermost edge 56 of rear panel 16 to neck 44. A pair of triangular side gable panels 58 and 60 extend from respective side walls 28 and 30 in an upward direction toward neck 44, and respective intermediate gable panels 62 and 64 are positioned between side gable panels 58 and 60 and rear gable panel 54 and front gable panel 48, respectively.

Figure 4:
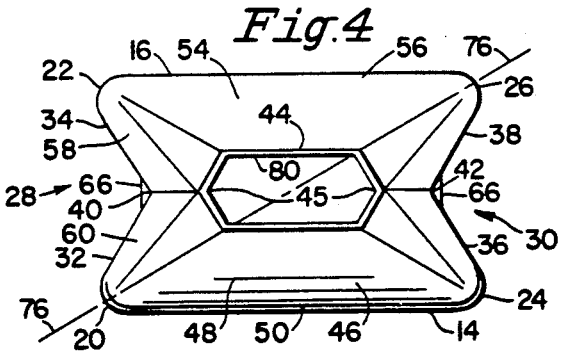
FIG. 4 is a top plan view of the collapsible container shown in FIG. 1.

Neck 44 has a predetermined longitudinal extent, and is of hexagonal shape and defined by a plurality of planar walls arranged in a hexagonal pattern as best seen in FIGS. 1 and 4. The respective gable panels are also planar and have edges defined by straight lines to facilitate collapsing of the bottle after use. Hexagonal neck 44 includes a pair of opposed, V-shaped pouring ends 45 to facilitate controlled pouring of the contents from the bottle.

As seen in FIGS. 1, 3, 4, and 5, side panels 28 and 30 each include a plurality of bridging members 66 that are positioned in spaced relationship along respective longitudinal hinge lines 40 and 42. Bridging members 66 bulge outwardly at the apices defined each of the pairs of associated side walls 32, 34 and 36, 38 of side panels 28 and 30, respectively, and extend across one of the associated longitudinal hinge lines 40, 42 from one side wall to the adjacent side wall and interrupt the associated longitudinal hinge line.

Figure 6:
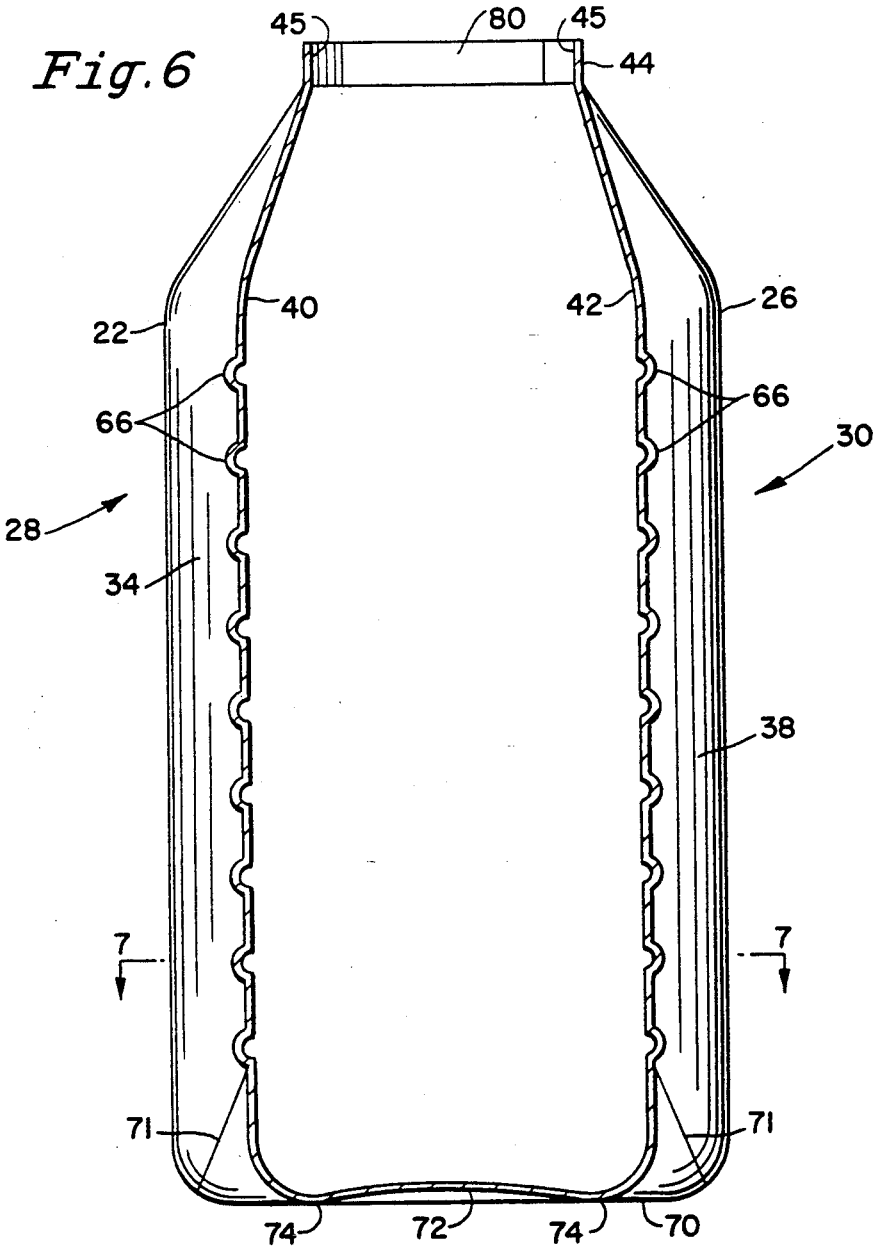
FIG. 6 is a longitudinal cross-sectional view taken along the line 6—6 of FIG. 3.

As shown in FIGS. 1, 3, and 6, bridging members 66 are substantially in the form of transversely extending gussets defined by arcuate inner and outer surfaces that present a convex surface on the outside of the bottle and a concave surface on the inside of the bottle. Bridging members 66 are preferably integrally formed with the body of bottle 10 during a blow molding operation and have a width dimension, taken in the direction of the longitudinal axis of the bottle, substantially equal to the width of grooves 18 formed in front panel 14 and in rear panel 16. It will be appreciated, however, that the width of bridging members 66 can also be different from that of grooves 18, to provide the desired degree of rigidity of side panels 28 and 30. Factors influencing the width of bridging members 66 include the material from which bottle 10 is formed, the wall thickness of side panels 28 and 30, the specific gravity of the material packaged within bottle 10, among others. Additionally, as shown in FIG. 3, the bridging members are positioned in the same transverse planes as are reinforcing grooves 18 formed in front panel 14 and in rear panel 16.

The length of bridging members 66, defined by the points at which members 66 intersect with each of side walls 32, 34 and 36, 38, is selected to provide the desired degree of rigidity to prevent excessive outward bowing or bulging of side panels 28 and 30. The length is dependent upon some of the same factors that influence the width of members 66, the most significant of which are identified in the preceding paragraph.

Bottle 10 includes a base defined by a bottom wall 70. Preferably, bottom wall 70 includes an inwardly dished or concave central recess area 72 to provide a surrounding border portion 74 that makes line contact with a surface on which bottle 10 is supported, to permit the bottle when filled to remain stable when in an upright position. In the absence of such an inwardly dished area, bottom wall 70 could assume a convex shape when the bottle is filled, thereby resulting in a condition known as a "rocker bottom," that results in instability of the bottle and permits it to rock in either a fore-and-aft or side-to-side direction.

Figure 5:
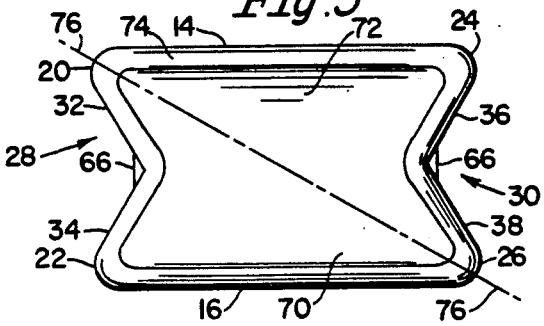
FIG. 5 is a bottom plan view of the collapsible container shown in FIG. 1.

Bottle 10 is preferably manufactured by the well-known process known as blow molding, and in that regard it is preferred for manufacturing purposes to have the blow molds (not shown) so configured that the mold parting line 76 passes diagonally of bottom wall 70 of bottle 10, as illustrated in FIGS. 4 and 5. The preferred materials from which the bottles are formed are thermoplastic polymers such as polyethylene terephthalate and polyethylene, although other thermoplastic polymers from which bottles can be blow molded would also be suitable.

Referring now to FIG. 3, side panel 28 includes several fold lines to facilitate folding of bottom wall 70 when the bottle is collapsed. A pair of angularly-extending fold lines 71, 73 are provided to extend upwardly along side walls 32, 34 from the corners of bottom wall 70 to join hinge line 40 at intersection 75 adjacent but below the lowermost bridging member 66. As shown in FIG. 3, fold lines 71, 73 and the lateral projection of bottom wall 70 define an isosceles triangle.

In addition to angularly extending fold lines 71, 73, a transverse fold line 77 formed in side wall 32 extends from intersection 75 in a direction substantially parallel with the lateral projection of bottom wall 70 to longitudinal edge 20 of front panel 14. Preferably, fold line 77 lies in a transverse plane that also passes through a groove 18 in front panel 14 to facilitate folding of the base when the bottle is collapsed.

Similarly oriented fold lines corresponding with fold lines 71, 73, and 77 are provided in side walls 36 and 38 of side panel 30, which is not visible in FIG. 3. The fold lines in side panel 30 are the mirror image of the fold lines in side panel 28. In each instance, fold lines 71, 73, and 77, and their counterparts in side panel 30, can be defined by linear surface depressions formed in the outwardly facing surfaces of each of side walls 32, 34 and 36, 38 during the blow molding process, such as by linear ridges provided in the corresponding mold cavity surfaces of the respective blow mold halves.

Figure 7:
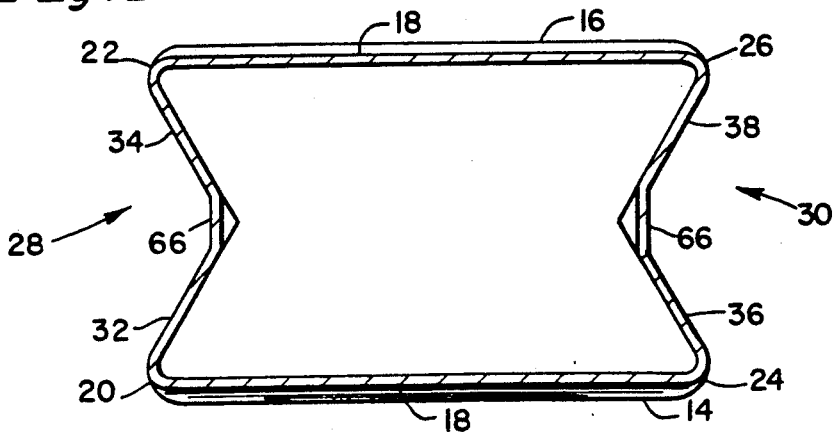
FIG. 7 is a transverse cross-sectional view taken along the line 7—7 of FIG. 2.

As best seen in FIGS. 6 and 7, the transversely extending grooves in the front and rear panels and the bridging members in the respective side panels are preferably integrally formed with the body of the bottle during the blow molding operation. The wall thicknesses of the various panels of the bottle, as well as the uniformity or non-uniformity of the wall thickness distribution, will be dependent upon the areas of the respective panels, which are dependent upon the bottle capacity and configuration, and also upon the inner and outer diameters of the parison or preform from which the bottle is blown.

The spacing between adjacent transverse grooves in the front and rear panels and adjacent bridging members in the side panels, taken in the direction of the longitudinal axis of the bottle, is preferably about 13.5 mm., in order to provide sufficient rigidity to front panel 14 and to rear panel 16, and also to minimize undesired outward bulging of the side panels when the container is filled with a liquid.

After the bottle is filled, opening 80 defined by the outermost end of neck 44 can be closed by welding or otherwise adhering a closure (not shown) in the form of a thin, flexible film or a rigid panel across the dispensing opening. Preferably the closure includes a film or panel that is of the same material as that from which the body of bottle 10 is formed, to permit recycling without the necessity for separating different materials. Such a closure can include an outwardly-extending pull tab, and the closure can either be punctured or it can be peeled from the container by the user grasping and pulling the pull tab to remove the closure and permit the contents of the container to be conveniently dispensed. Of course, other forms of closure can also be employed, if desired, as will be appreciated by those skilled in the art. For example, a snap-on closure cap of any of a number of configurations can also be applied to seal the opening defined by neck 44.

After the contents have been dispensed, bottle 10 can be conveniently collapsed to minimize the volume occupied by the bottle upon disposal. Collapse of the bottle can be effected by urging front panel 14 and rear panel 16 together to cause side walls 32, 34 and 36, 38 to pivot about their respective longitudinal hinge lines 40, 42, so that the outer surfaces of the adjacent pairs of side walls are brought into contacting relationship with each other as shown in FIG. 8, which shows in collapsed form an empty bottle 10 in accordance with the present invention.

Figure 8:
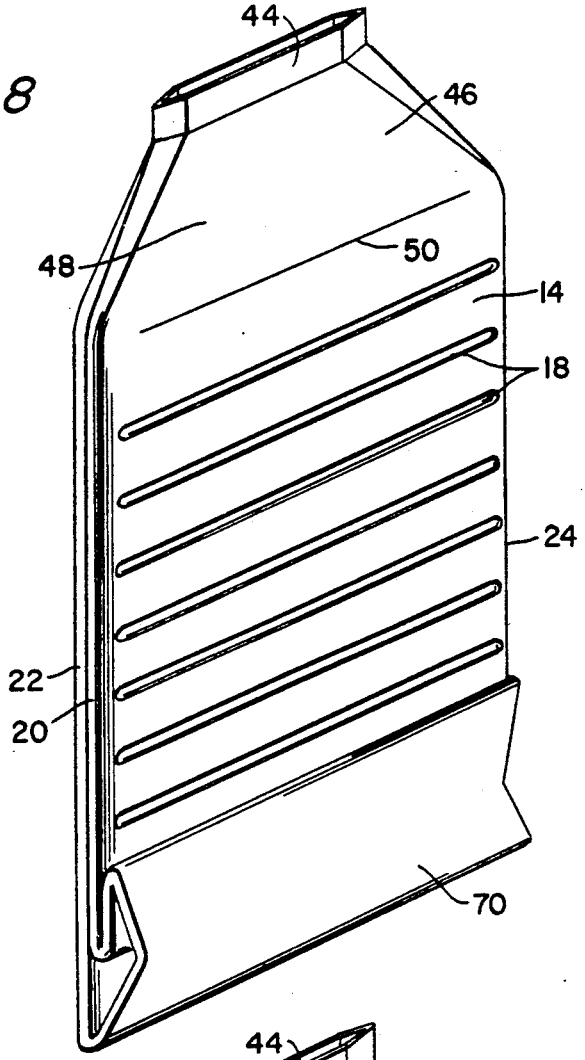
FIG. 8 is a perspective view showing the container of FIG. 1 in collapsed form with the base portion folded over to overlie the lower portion of the front panel.

In operation, the front and rear panels are pressed together by applying a pressing force on less than the totality of their respective surfaces, so that bottom wall 70 remains flat and about one-half of that wall overlies the lower portion of front panel 14, as shown in FIG. 8. The collapsing force is preferably applied to front panel 14 from a point beginning at the lowermost transverse groove 18 upward, so that when the side walls defining side panels 28 and 30 are brought together, folding occurs along fold lines 71, 73, and 77, and bottom wall 70 pivots upwardly about lowermost transverse groove 18.

Figure 9:
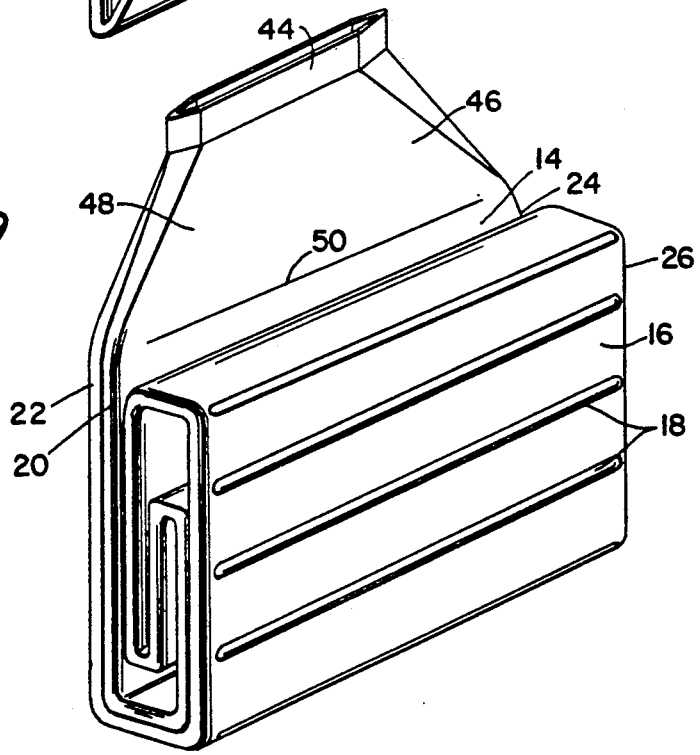
FIG. 9 is a perspective view of a collapsed container that has been rolled up to assume a more compact form.

In addition to merely flattening bottle 10 to the form shown in FIG. 8, if desired, bottle 10 can be folded over itself several times, or rolled up, as illustrated in FIG. 9. Transverse grooves 18 provide convenient fold lines to permit such rolling up of bottle 10.

It can thus be seen that the present invention provides distinct advantages over the prior art structures in that it permits a relatively thin walled container to be formed, without substantial outward bulging of the front, rear, and side panels when the container is filled with a liquid. Additionally, the container made in accordance with the structural features herein disclosed facilitates collapsing, and thereby occupies less volume when it has been emptied and discarded.

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within the scope of the present invention.

What is claimed is:

1. A collapsible container comprising a body having a bottle longitudinal axis and including spaced, opposed front and rear walls, a pair of spaced, opposed side walls connected with and extending between the front and rear walls, a bottom wall extending transversely of the bottle longitudinal axis and defining a base, the bottom wall connected with and extending between each of the opposed front and rear walls and the opposed side walls, and a dispensing opening spaced along the bottle longitudinal axis from the bottom wall, wherein the side walls are each defined by a pair of side panels that are connected together along a longitudinally extending hinge line, each side panel disposed at an acute angle with the respective connected front or rear wall and disposed at an obtuse included angle with the respective connected side panel, wherein said sidewalls extend inwardly and are each substantially V-shaped in transverse cross section, each side wall including a plurality of bridging members extending between and connected with each of the respective side panels of said side wall, the bridging members spaced from each other along the longitudinally extending hinge line to limit pivotal movement of the side panels relative to each other about the longitudinally extending hinge line when the bottle contains a fluid material.

2. A collapsible container in accordance with claim 1, wherein the side panels are substantially planar.

3. A collapsible container in accordance with claim 1, wherein the front and rear panels are substantially planar.

4. A collapsible container in accordance with claim 1 wherein the bridging members include gussets extending across the longitudinal hinge line of said side wall and wherein the gussets are connected with the hinge line and with adjacent surfaces of the respective side panels.

5. A collapsible container in accordance with claim 1, wherein the longitudinal spacing between successive bridging members is about 13.5 mm.

6. A collapsible container in accordance with claim 1, wherein at least one of the front and rear panels includes transversely extending stiffening grooves formed in the outer surface thereof to minimize outward deflection of the panel.

7. A collapsible container in accordance with claim 6, wherein the longitudinal spacing between adjacent stiffening grooves is about 13.5 mm.

8. A collapsible container in accordance with claim 6, wherein the stiffening grooves are substantially parallel.

9. A collapsible container in accordance with claim 6, wherein the stiffening grooves are defined by inwardly extending projections integrally formed in the respective front and rear walls.

10. A collapsible container in accordance with claim 1, including grooves formed in outwardly facing surfaces of each of the respective front and rear walls.

11. A collapsible container in accordance with claim 6, wherein the number of bridging members is equal to the number of stiffening grooves.

12. A collapsible container in accordance with claim 1, wherein the dispensing opening is defined by a plurality of interconnected linear surfaces, at least two of which interconnected surfaces define a V-shaped pouring surface.

13. A collapsible container in accordance with claim 1, wherein the container includes a mold parting line that defines a plane that extends diagonally relative to a transverse cross section of the container.

* * * * *